US005806093A

United States Patent [19]

Summers

[11] Patent Number: 5,806,093

[45] Date of Patent: Sep. 15, 1998

[54] UPPER BODY GARMENT

[76] Inventor: Neil Summers, Beechwood House, King Georges Hill, Abinger Bottom, Dorking, Surrey RH5 6JW, United Kingdom

[21] Appl. No.: 805,174

[22] Filed: Feb. 26, 1997

[30] Foreign Application Priority Data

Jun. 21, 1996 [GB] United Kingdom ..... 9613125

[51] Int. Cl.[6] ..... A41B 1/12

[52] U.S. Cl. ..... 2/69; 2/115

[58] Field of Search ..... 2/69, 115, 337, 2/227, 231, 44, 92, 94, 83, 85, 108, 267, 255, 258, 243.1, 455, 456, 113, 114; 601/76, 84, 85, 88, 134, 136, 138, 148, 149, 151; 606/201, 204

[56] References Cited

U.S. PATENT DOCUMENTS 5,086,519 2/1992 Rokasky ..... 2/408
5,297,293 3/1994 Obujen ..... 2/267
5,381,558 1/1995 Lo ..... 2/115
5,571,076 11/1996 Cooper ..... 602/19

FOREIGN PATENT DOCUMENTS 2 391 718 10/1976 France .
3644196 12/1986 Germany .
07268705 10/1995 Japan .

*Primary Examiner*—Gloria M. Hale
*Attorney, Agent, or Firm*—Baker & Daniels

[57] ABSTRACT

An upper body garment 1 which is provided with several rows of muscle relaxing pads 2 in areas arranged to face areas of the body in which muscle tension is likely to be a problem. The muscle relaxing pads 2 are in the form of arrays of resilient nodules 3 which extend inwardly to face the muscles of a wearer.

18 Claims, 2 Drawing Sheets

UPPER BODY GARMENT

The present invention relates to an upper body garment, and in particular, to one which can relax the muscles of the garment wearer.

According to the present invention, an upper body garment is provided in selected areas with muscle relaxing pads, each pad comprising an array of nodules of resilient material which extend inwardly from the garment.

When the garment is worn the wearer can readily relax a muscle simply by pressing the appropriately positioned pad against the adjacent muscle, thereby allowing the resilient nodules to massage the muscle.

The pads can be positioned in the arms of the garment so that the wearer can massage arm muscles by pressing a pad with one hand against the muscles in the arm. A particularly advantageous arrangement is to provide the pads in the back of the garment so that the back can be massaged simply by sitting back in a chair or lying face up on the floor. In this case, it is advantageous to provide pads extending down the parts of the garment which, in use, will be positioned on each side of the spine so as to allow the muscles adjacent to the spine to be massaged, but avoiding contact with the spine itself.

Pads can also be applied to the parts of the garment which, in use, face the neck or lower back of the wearer, as these areas are traditionally associated with uncomfortable muscle tension.

The pads which are provided extending along the spine, neck and lower back regions can either be in the form of a single continuous pad extending along the appropriate region, or, to provide greater flexibility in the garment, are in the form of a line of spaced apart pads spread along the appropriate region. The pads spaced along either side of the spine region should preferably be placed at centres spaced at a distance of between 3.5 and 4.5 cm, so that individual vertebrae can be positioned between a corresponding pair of pads.

In order to ensure that the garment hangs properly on the wearer to provide optimum contact between the pads and the wearer's body, the pads preferably progressively decrease in size from the top of the garment to the bottom. The way in which the garment hangs on the wearer can also be improved by reducing the weight of the pads. Thus, instead of the nodules being mounted on a base of the same resilient material, it is preferable for the nodules to be fused to a fabric base. The fabric is then sewn or otherwise attached to the garment.

The massaging action of the nodules can be improved if for each pad the envelope of the tips of the nodules presents to the inside of the garment one or more profiles which is convex in two dimensions, e.g. for back massage both a direction extending up the back of the wearer, and a direction extending across the back of the wearer, in use. Such convex profiles present one or more humps to the body of the wearer; which massage the body in a similar way to pads of thumbs during shiatsu massage. In one preferable arrangement, at least some of the pads have a envelope with a pair of convex profiles which mimic the action of two thumb pads during a normal massage.

An example of a garment constructed in accordance with the present invention will now be described with reference to the accompanying drawings, in which.

Figure 1:
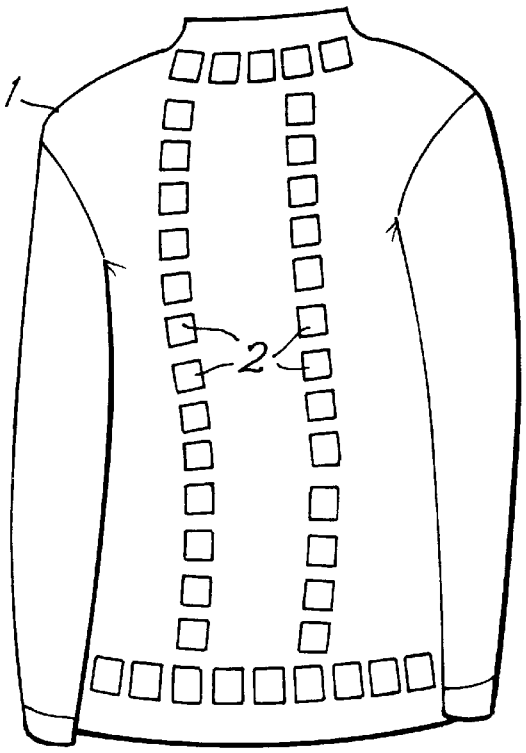
FIG. 1 is a view showing the arrangement of muscle relaxing pads on a garment according to the invention.

The garment 1 shown in FIG. 1 is provided with four rows of muscle relaxing pads 2 with two rows extending down the back of the garment one across the neck and one across the lower back.

Figure 2:
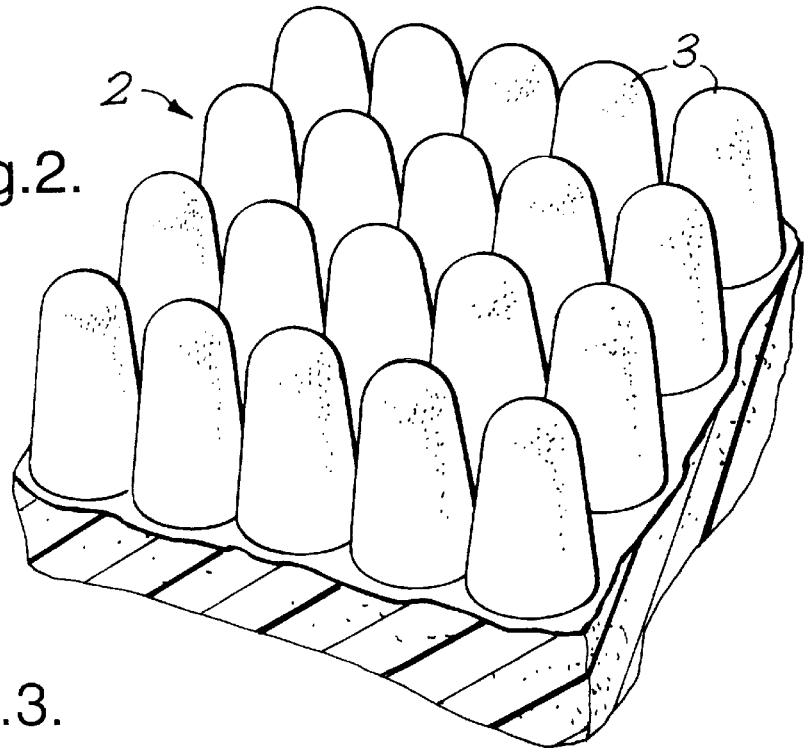
FIG. 2 is a perspective view of a portion of a pad.
Figure 3:
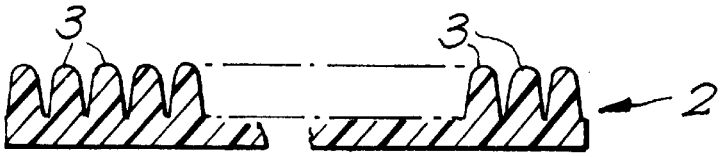
FIG. 3 is a cross-section through a pad.

Each pad is made of a square of rubber and is as shown in FIGS. 2 and 3. Each pad has an array of nodules 3 which extend inwardly from the garment towards the body of a wearer. Each nodule is tapered and has a part spherical tip. Typically, the spacing between the centre of the nodules is 7 mm.

It will be appreciated that when a person wearing the garment shown in FIG. 1 either sits back in the chair or lies face up on the floor the nodules 3 will be pressed against the corresponding regions of the back and will ease tension in the muscles against which they press.

Figure 4A:
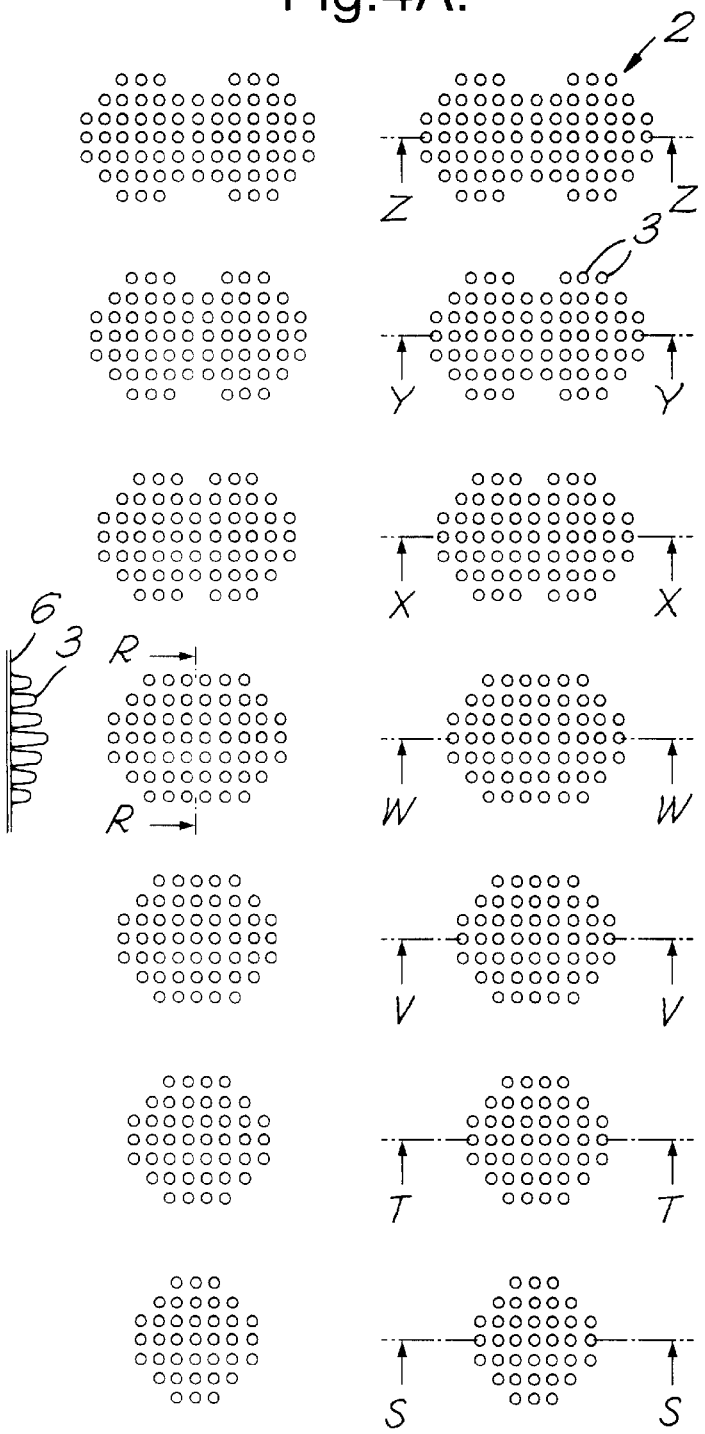
FIG. 4A is a plan view of a preferred arrangement of pads extending down the back of the garment.
Figure 4B:
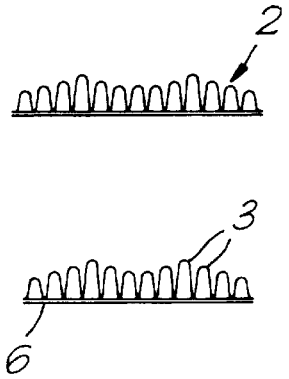
FIG. 4B is a series of cross sections of respective pads as shown in FIG. 4A.

The preferred arrangement of pads is shown in FIGS. 4A and 4B. The uppermost pads 2 are the largest in the sense that they are wider than the lower pads, with the width of the pads diminishing progressively down the garment.

From FIG. 4B it can be seen that the height of the nodules varies so that the envelope of the tips of the nodules of each pad provides a surface which is convex in both the horizontal and vertical directions as can be seen from the vertical section shown in FIG. 4A. The pads towards the upper part of the garment are shaped such that the profile provides a pair of convex humps 4 which mimic the action of a pair of thumb pads during normal massage. The profile of the pads, particularly towards the lower part of the garment have a single convex hump 5 which mimics the action of a single thumb pad.

FIGS. 4A and 4B also show the nodules 3 being fused to a fabric 6 such as brushed cotton. One or both of the vertical rows of pads may be provided on a single fabric strip, and the or each strip is sewn into the garment with the pads extending down each side of the centre line of the back of the garment.

I claim:

1. An upper body garment provided in selected areas of the back of the garment with at least one line of spaced-apart muscle relaxing pads;

each said pad comprising an array of nodules of resilient material extending inwardly from said garment;

wherein for each said pad, said nodules comprise inwardly facing tips that define an envelope presenting at least one inwardly facing profile which is convex in two directions.

2. A garment according to claim 1, the garment having sleeves in which the pads are provided.

3. A garment according to claim 1, wherein the pads are provided in the parts of the garment which are arranged to be positioned on each side of the spine of the wearer.

4. A garment according to claim 3, wherein the pads progressively decrease in size from the top of the garment to the bottom.

5. A garment according to claim 1, wherein the pads are provided in the part of the garment which is arranged to face the neck of the wearer.

6. A garment according to claim 1, wherein the pads are provided in the part of the garment which is arranged to face the lower back of the wearer.

7. A garment according to claim 1, wherein the pads are provided at centers spaced at a distance of between 3.5 and 4.5 cm.

8. A garment according to claim 7, wherein the pads progressively decrease in size from the top of the garment to the bottom.

9. A garment according to claim 1, wherein the pads progressively decrease in size from the top of the garment to the bottom.

10. A garment according to claim 1, wherein at least some of the pads have an envelope with a pair of convex profiles.

11. A garment according to claim 1, wherein the nodules are fused to a fabric base which is attached to the garment.

12. A garment according to claim 1, wherein said two directions are orthogonal to each other.

13. A garment according to claim 1, wherein the line of spaced-apart pads extends longitudinally down the back of the garment.

14. The garment of claim 1, wherein in at least some of said pads the envelope of said nodule tips presents at least two inwardly facing profiles each of which is convex in two directions.

15. A garment according to claim 14, wherein the pads are provided in the parts of the garment which are arranged to be positioned on each side of the spine of the wearer.

16. A garment according to claim 14, wherein the pads are provided in the part of the garment which is arranged to face the lower back of the wearer.

17. A garment according to claim 14, wherein the pads progressively decrease in size from the top of the garment to the bottom.

18. A garment according to claim 14, wherein the nodules are fused to a fabric base which is attached to the garment.

* * * * *